United States Patent [19]

Khandros et al.

[11] Patent Number: 4,536,232

[45] Date of Patent: Aug. 20, 1985

[54] EROSION AND CORROSION RESISTANT CAST IRON ALLOY CONTAINING CHROMIUM, NICKEL AND MOLYBDENUM

[75] Inventors: Igor Y. Khandros, Hoboken; Hugo R. Larson, Mahwah, both of N.J.

[73] Assignee: Abex Corporation, New York, N.Y.

[21] Appl. No.: 550,496

[22] Filed: Nov. 10, 1983

[51] Int. Cl.[3] ..... C22C 38/42

[52] U.S. Cl. ..... 148/35; 148/138; 75/125; 75/128 D; 75/128 W

[58] Field of Search ..... 148/35, 138, 3; 75/125, 75/128 D, 128 W, 125, 123 CB

[56] References Cited

U.S. PATENT DOCUMENTS 3,961,994 6/1976 Thome ..... 148/138
4,043,842 8/1977 Joiret ..... 148/138
4,080,198 3/1978 Heyer et al. ..... 148/35
4,382,828 5/1983 Henych ..... 148/138

FOREIGN PATENT DOCUMENTS 51-61422 5/1976 Japan ..... 75/128 D

*Primary Examiner*—L. Dewayne Rutledge
*Assistant Examiner*—Deborah Yee
*Attorney, Agent, or Firm*—Kinzer, Plyer, Dorn & McEachran

[57] ABSTRACT

Cast iron alloy preferably of about 1.6 carbon, 2 nickel, 2 molybdenum, 28 chromium, and up to 1 of an additional element, balance substantially iron characterized by a matrix substantially entirely of tempered martensite with minimal retained austenite, containing ferrite phases and primary chromium-rich carbides with substantially no secondary carbides.

2 Claims, 1 Drawing Figure

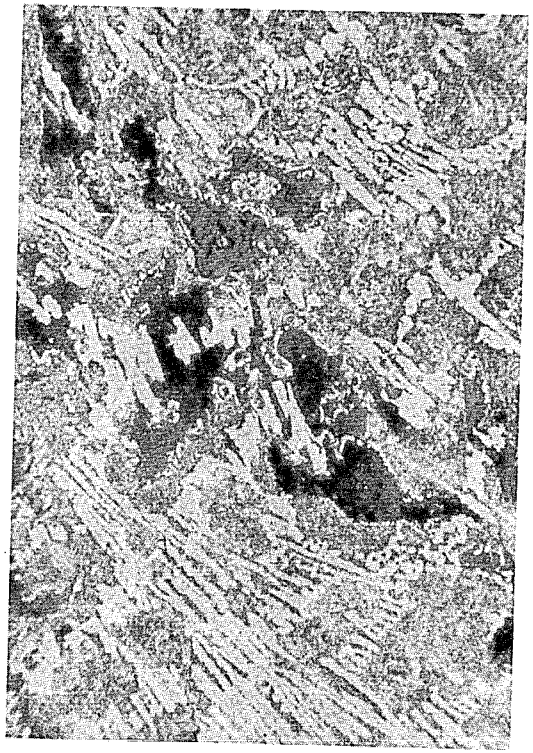

EROSION AND CORROSION RESISTANT CAST IRON ALLOY CONTAINING CHROMIUM, NICKEL AND MOLYBDENUM

This invention relates to a cast iron ("white iron") so composed and structured as to be superior to stainless steel for many applications where both corrosion and erosion of the metal may occur.

The invention stems from the alloy of U.S. Pat. No. 4,080,198 concerned with a cast iron composed of about 1.5 carbon, 2 nickel, 2 molybdenum, and 28 chromium, balance substantially iron (parts by weight). After casting and cooling the alloy is heat treated including an aging treatment at 1800° F. so that its microstructure comprises massive interdentric chromium carbides dispersed in a basically tough, nonbrittle austenitic matrix. The alloy is susceptible to accepting small amounts of copper, titanium, zirconium, boron, niobium, rare earth elements, etc., up to about one percent.

Superior and unexpected results are realized under this invention by so structuring the microstructure that the matrix is substantially tempered martensite, with minimal retained austenite; dispersed in the matrix are islands of ferrite and primary carbides; virtually no secondary carbides are present that can be observed by an optical microscope.

The problem faced was to enhance resistance of the patented alloy to erosion-corrosion influences in a highly acidic environment, say a pH less than one or two, and up to four, while still assuring machinability and resistance to wear. Slurry pump impeller parts made of the cast alloy are an example of commercial use where sometimes an acidic, eroding environment may be encountered.

The microstructure of the alloy has characteristics of both the stainless steels and the high chromium irons with large amounts of extremely hard (1700 DPH) primary chromium carbides. The metallurgical concept of the alloy recognized that a corrosion-erosion attack at low pH is predominantly a phenomenon of an accelerated corrosive attack due to the continuous removal of the passive surface layer by the erosive medium. It was therefore reasoned that rather than attempting to make the alloy as hard as possible through heat treatment, one keeps the chromium level in the matrix as high as possible to make the resources for continuous repassivation available. It was also decided to minimize the presence of "freshly" formed phases in the microstructure, as internal stresses in such phases would result in a higher corrosion rate. This specifically applies to fresh martensite, the presence of which is minimized by a second temper. The drawing is a photomicrograph showing the microstructure of the present alloy.

Refer now to the photomicrograph of the present microstructure. The substantially parallel striations or raylike structures extending diagonally are chromium-rich primary carbides; there are no secondary carbides dispersed in the matrix. This means chromium in the alloy is not consumed by formation of secondary ("precipitated") carbides and becomes available for the passivation role. The primary carbides themselves are adequate for wear resistance.

The larger, darker islands at the center and outward of the center of the photomicrograph are ferrite phases.

The matrix of the above-described structure is substantially entirely tempered martensite with a minimal amount of retained austenite, facilitating improved machinability.

As noted, the preferred chemistry of the patented alloy need not be altered, viz. (parts by weight):

C—1.6
Cr—28
Mo—2
Ni—2
Cu—up to 1
Fe—balance, substantially, except for foundry impurities or tramp elements However, instead of using a heat treatment regime which results in an austenitic matrix containing precipitated carbides (secondary chromium-rich carbides) the alloy according to the present invention is double tempered at about 1100°-1500° F. The upper temperature is chosen to avoid reaustenitization.

Two standards may be used for comparison: (1) a stainless steel which itself is intended for resistance to corrosion in highly acidic environments, and (2) the alloy of U.S. Pat. No. 4,080,198.

Experience with the alloy of the patent has established that prior to the present invention the best properties for the case alloy were developed by hardening at 1800° F. Comparative performance can be tested by simulating erosion (wearing) of the test part in an acidic slurry, much like that which would be handled by a pump, and extrapolating the wear loss to mils per year (MPY).

TABLE 1

Present Cast Alloy Versus Stainless Steel Alloys
Metal Loss in 20 Percent Alumina Slurry

| | Average Metal Loss in Mils Per Year | | | |
|---|---|---|---|---|
| | pH 0.75 | pH 2.5 | Neutral pH 7.0 | pH 11.0 |
| (1) Present Casting** | 64 | 41 | 24 | 23 |
| (2) CD4MCu | 166 | 147 | 70 | 67 |
| (3) CN7M | 177* | 207 | 105 | 138 |
| (4) CF8M | 218 | 159 | 69 | 90 |

Chemistry of Alloys of Table 1

| | (1) Present Casting** | (2) CD4MCu | (3) CN7M | (4) CF8M |
|---|---|---|---|---|
| C | 1.55/1.56 | 0.031 | 0.04 | 0.03 |
| Mn | .48/.89 | 0.55 | .74 | 0.81 |
| P | 0.045/0.046 | — | 0.012 | 0.11 |
| S | 0.013/0.028 | — | 0.015 | 0.010 |
| Si | 0.88/0.99 | 0.59 | 1.04 | 0.81 |
| Ni | 2.05/2.2 | 5.1 | 9.5 | 30.5 |
| Cr | 25.8/27.3 | 25.4 | 19.8 | 18.62 |
| Mo | 1.83/1.99 | 2.89 | 2.52 | 2.36 |
| Cu | — | — | — | 3.05 |
| Fe | Balance, substantially, except for foundry impurities and tramp elements | | | |

*2.5% $H_2SO_4$ added at start of testing; pH varied from 0.5 to 1.0
**Average metal loss for three heats having the chemistry range set forth above under
(1). All three heats double tempered: 1400° F., 4 hrs., A.C.; repeat 1400° F. 4 hrs., A.C.

TABLE 2

Present Cast Alloy Versus Patent Alloy*
Metal Loss in 20 Percent Alumina Slurry

| | Average Metal Loss in Mils Per Year | | | |
|---|---|---|---|---|
| | pH 0.75 | pH 2.5 | Neutral pH 7.0 | pH 11.0 |
| (1) Present Casting | 64 | 41 | 24 | 23 |

TABLE 2-continued

Present Cast Alloy Versus Patent Alloy*
Metal Loss in 20 Percent Alumina Slurry

| | Average Metal Loss in Mils Per Year | | | |
|---|---|---|---|---|
| | pH 0.75 | pH 2.5 | Neutral pH 7.0 | pH 11.0 |
| (2) Patent Alloy* | 2019 | 71 | 14 | 12 |

Notes:
(1) same heats as (1) of Table 1, same heat treatment; (2) same heats as (1) but aged by heat treatment of: 1200° F., 4 hrs., A.C.; 1200° F., 4 hrs., A.C.; 1800° F., 4 hrs., A.C. and finallay a normal stress relief treatment at 300° F.
*U.S. Pat. No. 4,080,198

The differences (MPY) are phenomenal and on examination of the microstructure it can be explained that by avoiding the hardening treatment at 1800° F. the chromium is not wasted in forming precipitated or secondary carbides. The corresponding amount of chromium retained in the matrix becomes a strategic reserve capable of playing the role of passivation as in a stainless steel by coating and guarding the underlying metal against acidic corrosion.

Subsequent testing for machinability establishes that the double temper drastically improves machinability (tapping, drilling, boring and turning) as compared to the as-cast alloy.

The alloy is naturally harder than a stainless steel because of the primary carbides dispersed in double tempered martensite. On the first temper (about 1100°-1500° F.) the austenite of the as-cast material is conditioned for transformation and during the subsequent air cool (A.C.) most of the austenite transforms to martensite. On the second temper (at about 1100°-1500° F.) the previously formed martensite is tempered, the remaining austenite is conditioned for transformation and during the subsequent air cooling period most of this austenite is transformed to martensite. Substantially all the austenite is so transformed so that the matrix for the most part is simply tempered martensite. Moreover there is a considerable retention of chromium for constantly renewing the passive film which prevents the underlying tempered martensite from being attacked by acid.

The preferred chemistry for the alloy is of course susceptible to some alteration, especially at the first decimal place. We believe carbon can be in the range of 1.2-2, with nickel and molybdenum in the range of 1-4 and chromium in the range of 24-32. As in the instance of the alloy of U.S. Pat. No. 4,080,198, the present alloy is susceptible of microalloying with an element selected from the group consisting of titanium, zirconium, boron, niobium and rare earth elements up to about one percent each. Some experts might contend the tempered martensite is bainite or that some bainite transformation occurs simultaneously with transformation to martensite.

The chemistry of the alloy shown in the photomicrograph and its heat treatment are the same as given under Table 1.

We claim:

1. A cast iron alloy in percent by weight consisting essentially of about 1.2 to 2 carbon, 1-4 nickel, 1-4 molybdenum, 24-32 chromium, up to 1 copper, and up to about one percent of a microalloying element selected from the group consisting to titanium, zirconium, boron, niobium and rare earth elements, balance substantially iron, characterized by a matrix substantially entirely of tempered martensite balance, if any, austenite, in which matrix is dispersed both primary chromium-rich carbides and ferrite islands but substantially no secondary carbides.

2. A method of producing a white cast iron alloy characterized by a matrix substantially entirely of tempered martensite and in which matrix is dispersed both primary chromium-rich carbides aand ferrite islands but substantially no secondary carbides, the alloy being composed (percent by weight) of about 1.2 to 2 carbon, 1-4 nickel, 1-4 molybdenum, 24-32 chromium, up to 1 copper, and up to one percent each of an element selected from the group consisting of titanium, zirconium, boron, niobium and rare earth elements, balance substantially iron, said method comprising the steps of casting said alloy subjecting the as-cast alloy to a heat treatment at about 1100°-1500° F. followed by air cooling to transform austenite to martensite, and heating the heat treated alloy a second time at about 1100°-1500° F. to temper the martensite followed by air cooling, to transform substantially all the remaining austenite to martensite.

* * * * *